US008268746B2

(12) United States Patent
Orihara et al.

(10) Patent No.: US 8,268,746 B2
(45) **Date of Patent: *Sep. 18, 2012**

(54) THERMOSENSITIVE RECORDING MATERIAL

(75) Inventors: Motoi Orihara, Numazu (JP); Tomohisa Kakuda, Numazu (JP); Yoshiaki Matsunaga, Numazu (JP); Eiji Fukui, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 12/555,896

(22) Filed: Sep. 9, 2009

(65) Prior Publication Data

US 2010/0062936 A1 Mar. 11, 2010

(30) Foreign Application Priority Data

Sep. 10, 2008 (JP) ..... 2008-232134
Sep. 16, 2008 (JP) ..... 2008-237045
Sep. 16, 2008 (JP) ..... 2008-237098

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | | |
|---|---|---|---|---|
| 4,758,547 | A | 7/1988 | Itabashi et al. | |
| 4,904,635 | A | 2/1990 | Tamagawa et al. | |
| 5,079,212 | A * | 1/1992 | Ishida et al. | 503/226 |
| 6,060,427 | A * | 5/2000 | Mori et al. | 503/200 |
| 7,098,168 | B2 * | 8/2006 | Iwasaki et al. | 503/209 |
| 7,192,904 | B2 * | 3/2007 | Iwasaki et al. | 503/216 |
| 2003/0039917 | A1 | 2/2003 | Naruse et al. | |
| 2005/0054527 | A1 | 3/2005 | Iwasaki et al. | |
| 2008/0096762 | A1 | 4/2008 | Takano et al. | |
| 2008/0146443 | A1 | 6/2008 | Matsunaga et al. | |
| 2008/0206496 | A1 | 8/2008 | Kobori et al. | |
| 2008/0220969 | A1 | 9/2008 | Matsunaga et al. | |
| 2008/0234128 | A1 | 9/2008 | Orihara et al. | |

FOREIGN PATENT DOCUMENTS

| | | | |
|---|---|---|---|
| CN | 1612812 | | 5/2005 |
| CN | 101143529 | | 3/2008 |
| DE | 102005050418 | A1 | 4/2007 |
| EP | 0291315 | A2 | 11/1988 |
| EP | 1 211 094 | * | 6/2002 |
| EP | 1243439 | A1 | 9/2002 |
| EP | 1 637 339 | * | 9/2005 |
| EP | 1900543 | A1 | 3/2008 |
| EP | 1964686 | A2 | 9/2008 |
| GB | 2181563 | A | 4/1987 |
| JP | 55-164192 | | 12/1980 |
| JP | 59-5093 | | 1/1984 |
| JP | 59-225987 | | 12/1984 |
| JP | 63-281886 | | 11/1988 |
| JP | 2-214688 | | 8/1990 |
| JP | 5-573 | | 1/1993 |
| JP | 8-151412 | | 6/1996 |
| JP | 2678358 | | 8/1997 |
| JP | 10-87936 | | 4/1998 |
| JP | 10-291367 | | 11/1998 |
| JP | 11-314457 | | 11/1999 |
| JP | 11-314458 | | 11/1999 |
| JP | 2001-293956 | | 10/2001 |
| JP | 2002-127601 | * | 5/2002 |
| JP | 2002-283717 | | 10/2002 |
| JP | 2003-182229 | | 7/2003 |
| JP | 2003-182246 | | 7/2003 |
| JP | 2005-313597 | | 11/2005 |
| JP | 2007-331260 | | 12/2007 |
| JP | 2008-73892 | | 4/2008 |
| JP | 4116772 | | 4/2008 |
| JP | 4221163 | | 11/2008 |

OTHER PUBLICATIONS

Jul. 13, 2010 Chinese official action (and English translation thereof) in connection with counterpart Chinese patent application.
Jan. 4, 2010 European search report in connection with counterpart European patent application No. 09 16 9839.

* cited by examiner

*Primary Examiner* — Bruce H Hess
(74) *Attorney, Agent, or Firm* — Cooper & Dunham LLP

(57) ABSTRACT

Provided is a thermosensitive recording material which can be produced through high-speed coating, which is excellent in head-matching property, and which can provide a printed image having good waterproofness, while maintaining high sensitivity and high storage stability, which material includes a support, an under layer laid over the support, the under layer containing a plastic hollow particle, a thermosensitive color-developing layer laid over the under layer, the thermosensitive color-developing layer containing a leuco dye and a developer, wherein two or more layers including the thermosensitive color-developing layer are formed through simultaneous coating by a curtain coating method.

12 Claims, No Drawings

THERMOSENSITIVE RECORDING MATERIAL

BACKGROUND

1. Technical Field

This disclosure relates to a thermosensitive recording material that can be used in a wide variety of fields, for example, in printers for computer output and calculators, recorders for medical instruments, low-speed and high-speed facsimiles, automatic ticket-vending machines, thermosensitive photography, handy terminals, and labels for the POS system.

2. Description of the Related Art

Various types of recording materials have been proposed in which a thermosensitive recording layer that contains as main components a colorless or light-colored leuco dye and a developer that produces color upon contact with the dye is provided on a support such as paper, synthetic paper and plastic film, so that developing reaction between the leuco dye and developer effected by application of heat or pressure are utilized. These types of thermosensitive recording materials require no troublesome treatments such as developing and fixing, offering such advantages as shorter recording time with a relatively simple device, low noise level, and low costs. These advantages have enabled them to be available not only for copying of books and documents, but also as recording materials for use in a variety of fields including computers, facsimiles, ticket machines, label printers, recorders, and handy terminals.

What is demanded for thermosensitive recording materials is quick, highly dense/sensitive developing, with high robustness in the developed image and background.

In regard to attempts to achieve increased sensitivity, methods have been proposed in which the thermal conductivity of a support is appropriately defined (Japanese Patent Application Laid-Open (JP-A) No. 55-164192) and in which an intermediate layer containing various types of hollow microparticles is formed on a support (JP-A Nos. 59-5093 and 59-225987). However, in these cases, it is difficult to form a uniform intermediate layer and the surface readily becomes uneven, leading to poor resolution (dot reproducibility) in the formed image. Furthermore, other methods have been proposed in which styrene acrylic resin and polystyrene resin are used as the partition materials of the above-described hollow microparticles (JP-A No. 63-281886) and in which an intermediate layer is formed, the main components of which are non-foamed hollow microparticles with a hollow ratio of 30% or more (JP-A No. 02-214688). However, even in these cases, adequate heat-insulating effects cannot be obtained since the hollow ratio is low, so that the highly sensitive thermosensitive recording material current being sought cannot be obtained.

Also, a method has been proposed in which an intermediate layer containing hollow particles with a hollow ratio of 80% or more is formed (JP-A No.05-573). This method can produce a thermosensitive recording material with higher sensitivity. However, when a thermosensitive color-developing layer is formed on the intermediate layer with, for example, a wire bar and a blade, considerable friction occurs between the coating head thereof and the intermediate layer, which degrades transferability. In addition, debris is likely to be formed due to friction, resulting in that high-speed coating cannot be performed. As described above, satisfactory results cannot be obtained with this method.

With regard to high-speed coating associated with recent demands for increased productivity, a curtain coating method has received attention for its advantages including significant reduction in expenditure involved in drying equipment and energy, which are achieved by increased coating speed and simultaneous multilayer coating. JP-A No. 2003-182229 discloses producing a thermosensitive recording layer by a curtain coating method in order to obtain a thermosensitive recording material which is excellent in sensitivity, image quality and head-matching property.

The curtain coating is a contour coating and thus, is suitably used for coating of a support with high smoothness (e.g., a film). However, when the support is a paper sheet with uneven surface profile, a smooth coated surface cannot be obtained, leading to uneven printing and/or degradation in glossiness of the printed product.

Furthermore, in recent years, such thermosensitive recording materials have come to be abundantly used in fields where fidelity of recorded images is deemed critical, such as labels and receipts. Accordingly, thermosensitive recording materials are in demand that have high resistance against water and acidic substances in foods, and oils and fats and plasticizers in organic polymer materials used in packages. Meanwhile, thermosensitive recording materials are used under various environmental conditions. In particular, when used under high-temperature, high-humidity conditions, the thermosensitive recording materials may involve sticking by which normal printing is inhibited and thus, are required to have excellent head-matching property.

There have been attempts to overcome the aforementioned problems for instance by providing a protective layer on the thermosensitive recording layer. In particular, it has been proposed that polyvinyl alcohols or modified polyvinyl alcohols be used as the resin for a protective layer, and that these polyvinyl alcohols and a waterproofing agent be used together as the protective layer.

For example, JP-A No. 08-151412 discloses using a hydrazine compound and a diacetone group-containing polyvinyl alcohol, but when they are used in a protective layer of the thermosensitive recording material, the reaction for waterproofness is promoted in their coating liquids followed by unwanted increase in viscosity over time. Also, JP-A No. 10-291367 discloses using an acetoacetyl-modified polyvinyl alcohol in a thermosensitive recording layer or protective layer, and using a ketone resin as a crosslinking agent. Further, JP-A No. 11-314458 discloses using an acetoacetyl-modified polyvinyl alcohol in a protective layer and using a hydrazine compound serving as a crosslinking agent in a thermosensitive recording layer. In both cases, the formed protective layer is poor in waterproofness and head-matching property. In addition, JP-A No. 11-314457 proposes that a diacetone-modified polyvinyl alcohol be used in the resin of a protective layer and that a hydrazine compound be contained in the thermosensitive color-developing layer, but the problems arise that the waterproofness of the protective layer is insufficient, the viscosity of the coating liquid on the thermosensitive color-developing layer increases and developing of the thermosensitive color-developing layer is inhibited by the hydrazide compound. Furthermore, in JP-A No. 10-87936, a waterproofing method is proposed that uses a water-soluble amine, a hydrazide compound and a polyvinyl alcohol copolymer containing diacetone acryl amide as a monomer. However, when they are used in a protective layer of the thermosensitive recording material, the amine undesirably affects the thermosensitive color-developing layer to cause coloring in the background, pH control by the amine becomes difficult and, depending on the amount of amine added, viscosity increases conversely.

Regarding increase in viscosity, JP-A No. 2002-283717 attempts to solve this problem by using a hydrazide compound as a crosslinking agent for a polyvinyl alcohol having a reactive carbonyl group, and also by incorporating a basic filler.

When thermosensitive recording materials that use a hydrazide compound and polyvinyl alcohol containing a reactive carbonyl group are used, however, an image printed with aqueous ink for flexography is easily peeled off by external force after long-time exposure to water.

Meanwhile, the curtain coating method has received attention for its advantages including significant reduction in expenditure involved in drying equipment and energy, which are achieved by increased coating speed and simultaneous multilayer coating associated with recent demands for increased productivity. JP-A No. 2003-182229 discloses producing a thermosensitive recording layer and a protective layer by a curtain coating method similar to the present invention, in order to obtain a thermosensitive recording material which is excellent in sensitivity, image quality and head-matching property.

However, this patent literature remains silent with respect to a thermosensitive recording material which offers a printed image excellent in waterproofness and head-matching property and which can be produced through high-speed coating. Needless to say, this neither describes nor suggests that a protective layer having a two-layered structure is formed, and that a maleic acid-modified polyvinyl alcohol is contained in the second protective layer.

As described above, none of them has provided a thermosensitive recording material which can be produced through high-speed coating and which has high sensitivity and excellent storage stability.

BRIEF SUMMARY

In an aspect of this disclosure, there is provided a thermosensitive recording material which can be produced through high-speed coating, which offers a printed image excellent in waterproofness, and which has high sensitivity and excellent storage stability.

The present inventors found through extensive studies that the aforementioned advantageous results can be obtained by simultaneously coating by a curtain coating method two or more constituent layers of a thermosensitive recording material which include a thermosensitive color-developing layer.

Various features and aspects can be provide, including, for example, the following.

<1> A thermosensitive recording material including:

a support, an under layer laid over the support, the under layer containing a plastic hollow particle, a thermosensitive color-developing layer laid over the under layer, the thermosensitive color-developing layer containing a leuco dye and a developer, wherein two or more layers including the thermosensitive color-developing layer are formed through simultaneous coating by a curtain coating method.

<2> The thermosensitive recording material according to <1> above, wherein first and second layers which are formed through the simultaneous coating by the curtain coating method are the thermosensitive color-developing layer and a protective layer containing a water-soluble resin, a crosslinking agent and a pigment, respectively.

<3> A thermosensitive recording material according to any one of <1> and <2> above, wherein first, second and third layers which are formed through the simultaneous coating by the curtain coating method are the thermosensitive color-developing layer, a first protective layer containing a water-soluble resin and a crosslinking agent, a second protective layer containing a water-soluble resin, a crosslinking agent and a pigment, respectively.

<4> The thermosensitive recording material according to <3> above, wherein each of the water-soluble resins is a modified polyvinyl alcohol selected from the group consisting of an itaconic acid-modified polyvinyl alcohol, a maleic acid-modified polyvinyl alcohol and an acetoacetyl-modified polyvinyl alcohol.

<5> The thermosensitive recording material according to <3> above, wherein the water-soluble resins are the same.

<6> The thermosensitive recording material according to <3> above, wherein the second protective layer is formed by a blade coating method.

<7> The thermosensitive recording material according to any one of <1> to <6> above, wherein the under layer is formed by a blade coating method.

<8> The thermosensitive recording material according to any one of <2> to <7> above, wherein the pigment is a basic filler which is aluminum hydroxide, calcium carbonate or a mixture thereof.

<9> The thermosensitive recording material according to any one of <1> to <8> above, wherein the thermosensitive recording material contains a silicone resin particle in an uppermost layer thereof.

<10> The thermosensitive recording material according to any one of <1> to <9> above, further including a back layer over the back surface of the support, wherein the back layer contains a water-soluble resin, a crosslinking agent and a pigment.

<11> The thermosensitive recording material according to any one of <1> to <10> above, further including an adhesive layer and a release paper which are sequentially laminated over the back surface of the support or the back layer.

<12> The thermosensitive recording material according to any one of <1> to <10> above, further including a thermosensitive adhesive layer over the back surface of the support or the back layer, wherein the thermosensitive adhesive layer develops adhesiveness by the action of heat.

<13> The thermosensitive recording material according to any one of <1> to <10> above, further including a magnetic recording layer over the back surface of the support or the back layer.

<14> The thermosensitive recording material according to any one of <4> to <13> above, wherein the water-soluble resin contained in the first protective layer is an itaconic acid-modified polyvinyl alcohol.

<15> The thermosensitive recording material according to any one of <4> to <13> above, wherein the water-soluble resin contained in the first protective layer is a maleic acid-modified polyvinyl alcohol.

<16> The thermosensitive recording material according to any one of <4> to <13> above, wherein the water-soluble resin contained in the first protective layer is an acetoacetyl-modified polyvinyl alcohol.

Thus, a thermosensitive recording material can be produced through high-speed coating, which has high sensitivity and excellent storage stability, which offers a printed image excellent in waterproofness, and which is excellent in head-matching property.

DETAILED DESCRIPTION OF THE INVENTION

Next will be described preferred embodiments of the present invention.

(Thermosensitive Recording Material)

A thermosensitive recording material of the present invention includes a support, an under layer and a thermosensitive color-developing layer; and, if necessary, includes other layers.

The shape, structure and size of the thermosensitive recording material of the present invention are not particularly limited and may be appropriately selected in accordance with the intended purpose. Also, a method for producing the thermosensitive recording material of the present invention is not particularly limited, so long as two or more layers including the thermosensitive color-developing layer are formed through simultaneous coating by a curtain coating method, and may be selected depending on the purpose.

—Curtain Coating Method—

In the present invention, a curtain coating method is a method in which a desired coating liquid (e.g., a thermosensitive color-developing layer-coating liquid) is discharged from a head onto the below-described support to form a thin curtain film of the coating liquid, thereby coating it on the support. Also, in the present invention, simultaneous coating by a curtain coating method is a coating method in which desired two or more different coating liquids (including a thermosensitive color-developing layer-coating liquid) are accommodated in separate head portions, and discharged from the corresponding heads onto a support as described above. According to the present invention, two or more layers including the thermosensitive color-developing layer are formed through simultaneous coating by a curtain coating method and thus, a thermosensitive recording material having satisfactory characteristics can be obtained while realizing decrease in the number of steps, reduction of cost for facility introduction, and easy multilayer coating.

The layers to be formed through simultaneous coating by a curtain coating method are not particularly limited, so long as they are two or more layers including the thermosensitive color-developing layer, and may be appropriately selected depending on the purpose. For example, the thermosensitive color-developing layer may be formed simultaneously with the below-described protective layer to be formed on the thermosensitive color-developing layer. Also, as described below, when the protective layer is composed of two or more layers (e.g., first and second protective layers), the thermosensitive color-developing layer and the first and second protective layers may be formed through simultaneous coating. Alternatively, the thermosensitive color-developing layer and the first protective layer may be formed through simultaneous coating by a curtain coating method, and the second protective layer may be formed by another coating method such as a blade coating method.

The coating liquids used in a curtain coating method preferably have a viscosity (as measured at 25° C. with a B type viscometer) of 100 mPa·s to 500 mPa·s, particularly preferably 150 mPa·s to 400 mPa·s. When the viscosity is lower than 100 mPa·s, the coating liquids are mixed with each other, leading to a drop in sensitivity, etc. Whereas when the viscosity is higher than 500 mPa·s, the difference in flow rate occurs between the center portion of a curtain nozzle and the edge guide thereof. As a result, the deposition amount at edge portions increases to form convex portions.

<Thermosensitive Color-Developing Layer>

The thermosensitive color-developing layer contains a leuco dye and a developer and is formed over the under layer.

—Leuco Dye—

The leuco dye used in the present invention is a compound exhibiting electron donation properties, and may be used singly or in combination of two or more species. However, the leuco dye itself is a colorless or light-colored dye precursor, and commonly known leuco compounds can be used, for example triphenylmethane phthalide compounds, triarylmethane compounds, fluoran compounds, phenothiazine compounds, thiofluoran compounds, xanthen compounds, indolyl phthalide compounds, spiropyran compounds, azaphthalide compounds, chlormenopirazole compounds, methyne compounds, rhodamine anilinolactum compounds, rhodamine lactum compounds, quinazoline compounds, diazaxanthen compounds, bislactone compounds and the like. In consideration of color development property, fogging of the background, and color fading of the image due to moisture, heat or light radiation, specific examples of such compounds are as follows.

2-anilino-3-methyl-6-diethyl amino fluoran, 2-anilino-3-methyl-6-(di-n-butyl amino)fluoran, 2-anilino-3-methyl-6-(di-n-pentyl amino)fluoran, 2-anilino-3-methyl-6-(N-n-propyl-N-methyl amino)fluoran, 2-anilino-3-methyl-6-(N-isopropyl-N-methyl amino)fluoran, 2-anilino-3-methyl-6-(N-isobutyl-N-methyl amino)fluoran, 2-anilino-3-methyl-6-(N-n-amyl-N-methyl amino)fluoran, 2-anilino-3-methyl-6-(N-sec-butyl-N-ethyl amino)fluoran, 2-anilino-3-methyl-6-(N-n-amyl-N-ethyl amino)fluoran, 2-anilino-3-methyl-6-(N-iso-amyl-N-ethyl amino)fluoran, 2-anilino-3-methyl-6-(N-cyclohexyl-N-ethyl amino)fluoran, 2-anilino-3-methyl-6-(N-ethyl-p-toluidino)fluoran, 2-anilino-3-methyl-6-(N-methyl-p-toluidino)fluoran, 2-(m-trichloro methyl anilino)-3-methyl-6-diethyl amino fluoran, 2-(m-trichloro methyl anilino)-3-methyl-6-diethyl amino fluoran, 2-(m-trichloro methyl anilino)-3-methyl-6-(N-cyclohexyl-N-methyl amino)fluoran, 2-(2,4-dimethyl anilino)-3-methyl-6-diethyl amino fluoran, 2-(N-ethyl-p-toluidino)-3-methyl-6-(N-ethyl anilino)fluoran, 2-(N-methyl-p-toluidino)-3-methyl-6-(N-propyl-p-toluidino)fluoran, 2-anilino-6-(N-n-hexyl-N-ethyl amino)fluoran, 2-(o-chloranilino)-6-diethyl amino fluoran, 2-(o-bromoanilino)-6-diethyl amino fluoran, 2-(o-chloranilino)-6-dibutyl amino fluoran, 2-(o-fluoroanilino)-6-dibutyl amino fluoran, 2-(m-trifluoro methyl anilino)-6-diethylamino fluoran, 2-(p-acetyl anilino)-6-(N-n-amyl-N-n-butyl amino)fluoran, 2-benzyl amino-6-(N-ethyl-p-toluidino)fluoran, 2-benzyl amino-6-(N-methyl-2,4-dimethyl anilino)fluoran, 2-benzyl amino-6-(N-ethyl-2,4-dimethyl anilino)fluoran, 2-dibenzyl amino-6-(N-methyl-p-toluidino)fluoran, 2-dibenzyl amino-6-(N-ethyl-p-toluidino)fluoran, 2-(di-p-methyl benzyl amino)-6-(N-ethyl-p-toluidino)fluoran, 2-(α-phenyl ethyl amino)-6-(N-ethyl-p-toluidino)fluoran, 2-methyl amino-6-(N-methyl anilino)fluoran, 2-methyl amino-6-(N-ethyl anilino)fluoran, 2-methyl amino-6-(N-propyl anilino)fluoran, 2-ethyl amino-6-(N-methyl-p-toluidino)fluoran, 2-methyl amino-6-(N-methyl-2,4-dimethyl anilino)fluoran, 2-ethyl amino-6-(N-methyl-2,4-dimethyl anilino)fluoran, 2-dimethyl amino-6-(N-methyl anilino)fluoran, 2-dimethyl amino-6-(N-ethyl anilino)fluoran, 2-diethyl amino-6-(N-methyl-p-toluidino)fluoran, benzo leuco methylene blue, 2-[3,6-bis(diethyl amino)]-6-(o-chloranilino)xanthyl benzoic acid lactum, 2-[3,6-bis(diethyl amino)]-9-(o-chloranilino)xanthyl benzoic acid lactum, 3,3-bis(p-dimethyl amino phenyl)phthalide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorphthalide, 3,3-bis(p-dibutyl amino phenyl)phthalide, 3-(2-methoxy-4-dimethyl amino phenyl)-3-(2-hydroxy-4,5-dichlorphenyl)phthalide, 3-(2-hydroxy-4-dimethyl amino phenyl)-3-(2-methoxy-5-chlorphenyl)phthalide, 3-(2-hydroxy-4-dimethoxy amino phenyl)-3-(2-methoxy-5-chlorphenyl)phthalide, 3-(2-hydroxy-4-dimethoxy amino phenyl)-3-(2-methoxy-5-nitrophenyl)phthalide, 3-(2-hydroxy-4-diethyl amino phenyl)-3-(2-methoxy-5-methyl phenyl)phthalide, 3,6-bis(dimethyl amino)fluorenespiro(9,3')-6'-dimethyl amino phthalide, 6'-chloro-8'-methoxy-benzoindolino spiropyran, 6'-bromo-2'-methoxy benzoindolino spiropyran and the like.

—Developer—

Also, as the developer used in the present invention, various electron accepting substances are suitable which react with the aforementioned leuco dye at the time of heating and cause this to develop colors. Examples thereof include phenolic compounds, organic or inorganic acidic compounds and esters or salts thereof.

Specific examples include bisphenol A, tetrabromobisphenol A, gallic acid, salicylic acid, 3-isopropyl salicylate, 3-cyclohexyl salicylate, 3-5-di-tert-butyl salicylate, 3,5-di-α-methyl benzyl salicylate, 4,4'-isopropylidenediphenol, 1,1'-isopropylidene bis(2-chlorophenol), 4,4'-isopropylene bis(2,6-dibromophenol), 4,4'-isopropylidene bis(2,6-dichlorophenol), 4,4'-isopropylidene bis(2-methyl phenol), 4,4'-isopropylidene bis(2,6-dimethyl phenol), 4,4'-isopropylidene bis(2-tert-butyl phenol), 4,4'-sec-butylidene diphenol, 4,4'-cyclohexylidene bisphenol, 4,4'-cyclohexylidene bis(2-methyl phenol), 4-tert-butyl phenol, 4-phenyl phenol, 4-hydroxy diphenoxide, α-naphthol, β-naphthol, 3,5-xylenol, thymol, methyl-4-hydroxybenzoate, 4-hydroxyacetophenone, novolak phenol resins, 2,2'-thio bis(4,6-dichloro phenol), catechol, resorcin, hydroquinone, pyrogallol, fluoroglycine, fluoroglycine carboxylate, 4-tert-octyl catechol, 2,2'-methylene bis(4-chlorophenol), 2,2'-methylene bis(4-methyl-6-tert-butyl phenol), 2,2'-dihydroxy diphenyl, ethyl p-hydroxybenzoate, propyl p-hydroxybenzoate, butyl p-hydroxybenzoate, benzyl p-hydroxybenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphthoic acid, 2-hydroxy-6-naphthoic acid, 2-hydroxy-6-zinc naphthoate, 4-hydroxy diphenyl sulphone, 4-hydroxy-4'-chloro diphenyl sulfone, bis(4-hydroxy phenyl)sulfide, 2-hydroxy-p-toluic acid, 3,5-di-tert-zinc butyl salicylate, 3,5-di-tert-tin butyl salicylate, tartaric acid, oxalic acid, maleic acid, citric acid, succinic acid, stearic acid, 4-hydroxyphthalic acid, boric acid, thiourea derivatives, 4-hydroxy thiophenol derivatives, bis(4-hydroxyphenyl)acetate, bis(4-hydroxyphenyl) ethyl acetate, bis(4-hydroxyphenyl)acetate-n-propyl, bis(4-hydroxyphenyl)acetate-n-butyl, bis(4-hydroxyphenyl) phenyl acetate, bis(4-hydroxyphenyl)benzyl acetate, bis(4-hydroxyphenyl)phenethyl acetate, bis(3-methyl-4-hydroxyphenyl)acetate, bis(3-methyl-4-hydroxyphenyl) methyl acetate, bis(3-methyl-4-hydroxyphenyl)acetate-n-propyl, 1,7-bis(4-hydroxyphenylthio)3,5-dioxaheptane, 1,5-bis(4-hydroxyphenylthio)3-oxaheptane, 4-hydroxy phthalate dimethyl, 4-hydroxy-4'-methoxy diphenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isopropoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzoxy)diphenyl sulfone, 4-hydroxy-4'-(p-methyl benzoxy) diphenyl sulfone, 4-hydroxy-4'-(o-methyl benzoxy)diphenyl sulfone, 4-hydroxy-4'-(p-chloro benzoxy)diphenyl sulfone and 4-hydroxy-4'-oxyaryl diphenyl sulfone.

The amount of the leuco dye contained in the thermosensitive color-developing layer is preferably 5% by mass to 20% by mass, more preferably 10% by mass to 15% by mass. When the amount is less than 5% by mass, developed color density cannot be obtained to a satisfactory extent, whereas when the amount is more than 20% by mass, the effect commensurate with the amount cannot be attained with respect to developed color density.

In the thermosensitive recording layer, the relative amount (mixing ratio) of the developer to the leuco dye (1 part by mass) is preferably 0.5 parts by mass to 10 parts by mass, particularly preferably 1 part by mass to 5 parts by mass. When the relative amount of the developer is less than 0.5 parts by mass, developed color density cannot be obtained to a satisfactory extent, whereas when the relative amount of the developer is more than 10 parts by mass, the effect commensurate with the amount cannot be attained with respect to developed color density.

Besides the above-described leuco dye and developer, it is possible to appropriately add, to the thermosensitive color-developing layer, other materials customarily used in thermosensitive recording materials, such as a binder, a filler, a hot-melt material, a crosslinking agent, a pigment, a surfactant, a fluorescent whitening agent and a lubricant.

—Binder—

The binder may be used as necessary in order to improve the adhesiveness and coatability of the layer. Specific examples include starches, hydroxyethyl cellulose, methyl cellulose, carboxy methyl cellulose, gelatin, casein, gum arabic, polyvinyl alcohols, salts of diisobutylene/maleic anhydride copolymers, salts of styrene/maleic anhydride copolymers, salts of ethylene/acrylic acid copolymers, salts of styrene/acryl copolymers and emulsion salts of styrene/butadiene copolymers.

—Filler—

Examples of the filler include, but not limited to, inorganic pigments such as calcium carbonate, aluminum oxide, zinc oxide, titanium dioxide, silica, aluminum hydroxide, barium sulfate, talc, kaolin, alumina and clay, and commonly known organic pigments. In addition, when waterproofness (resistance against peeling off due to water) is taken into consideration, acidic pigments (those which exhibit acidity in aqueous solutions) such as silica, alumina and kaolin are preferable, with silica being particularly preferable from the viewpoint of developed color density.

It is also preferable to use the hot-melt material in combination. Specific examples thereof include fatty acids such as stearic acid and behenic acid; fatty acid amides such as stearic acid amide, erucic acid amide, palmitic acid amide, behenic acid amide and palmitic acid amide; N-substituted amides such as N-lauryl lauric acid amide, N-stearyl stearic acid amide and N-oleyl stearic acid amid; bis fatty acid amides such as methylene bis stearic acid amide, ethylene bis stearic acid amide, ethylene bis lauric acid amide, ethylene bis capric acid amide and ethylene bis behenic acid amide; hydroxyl fatty acid amides such as hydroxyl stearic acid amide, methylene bis hydroxyl stearic acid amide, ethylene bis hydroxyl stearic acid amide and hexamethylene bis hydroxy stearic acid amide; metal salts of fatty acids, such as zinc stearate, aluminum stearate, calcium stearate, zinc palmitate and zinc behenate; p-benzyl biphenyl, terphenyl, triphenyl methane, benzyl p-benzyloxybenzoate, β-benzyloxy naphthalene, phenyl β-naphthoate, 1-hydroxy-2-phenyl naphthoate, methyl 1-hydroxy-2-naphthoate, diphenyl carbonate, benzyl terephthalate, 1,4-dimethoxy naphthalene, 1,4-diethoxy naphthalene, 1,4-dibenzyloxy naphthalene, 1,2-diphenoxy ethane, 1,2-bis(4-methyl phenoxy ethane), 1,4-diphenoxy-2-butene, 1,2-bis(4-methoxy phenyl thio)ethane, dibenzoyl methane, 1,4-diphenylthio butane, 1,4-diphenylthio-2-butene, 1,3-bis(2-vinyloxy ethoxy)benzene, 1,4-bis(2-vinyloxy ethoxy) benzene, p-(2-vinyloxy ethoxy)biphenyl, p-aryloxy biphenyl, dibenzoyloxymethane, dibenzoyloxypropane, dibenzyl sulfide, 1,1-diphenyl ethanol, 1,1-diphenyl propanol, p-benzyloxy benzyl alcohol, 1,3-phenoxy-2-propanol, N-octadecyl carbamoyl-p-methoxy carbonyl benzene, N-octadecyl carbamoyl benzene, 1,2-bis(4-methoxyphenoxy)propane, 1,5-bis(4-methoxyphenoxy)-3-oxapentane, dibenzyl oxalate, bis(4-methyl benzyl)oxalate and bis(4-chlorobenzyl)oxalate. These may be used singly or in combination.

In recent years, fluorescent whitening agents have been included to whiten the background area and improve appearance. From the viewpoints of the effect of improving background whiteness and the stability of the protective layer liquid, diaminostilbene compounds are preferable. The fluorescent whitening agent may be incorporated into any of the layers, so long as the effect of improving background whiteness can be obtained.

Further, when N-aminopolyacryl amide serving as a crosslinking agent is added to the thermosensitive color-developing layer and the protective layer, preferably, diacetone-modified polyvinyl alcohol is incorporated into the thermosensitive color-developing layer. This is because a crosslinking reaction readily occurs, and waterproofness can be improved without adding another crosslinking agent that could impede color formation.

The thermosensitive recording layer can be formed though a commonly known method. For example, the leuco dye and developer have been pulverized and dispersed together with the binder and the other components so as to be a particle diameter of 1 μm to 3 μm by a disperser such as a ball mill, Atriter and sand mill. The resultant dispersion is mixed, if necessary, together with the filler and the hot-melt material (sensitizer) dispersion liquid in accordance with a predetermined formulation, to thereby prepare a thermosensitive recording layer-coating liquid. Subsequently, the thus-prepared coating liquid is used to form a layer on the support through simultaneous coating by a curtain coating method.

The thickness of the thermosensitive recording layer varies depending on the composition of the thermosensitive recording layer and intended use of the thermosensitive recording materials and cannot be specified flatly, but it is preferably 1 μm to 50 μm, more preferably 3 μm to 20 μm.

<Protective Layer>

The protective layer is not particularly limited, so long as it can protect the thermosensitive recording material physically/chemically, and may be selected depending on the purpose. The protective layer may have a single layer or two or more layers. Preferably, the protective layer is a laminate of two or more layers, since technical features of the present invention can be obtained. The curtain coating method enables two or more layers to be coated with a single coater, resulting in that the formed layers can be functionally separated. For example, when a single layer with two functions is separated into two layers, the function of each layer is more clearly obtained and thus improved.

The material for the protective layer is not particularly limited, so long as it can achieve the above object, and may be appropriately selected depending on the purpose. Examples of the material include water-soluble resins (binder resins), crosslinking agents and pigments. The protective layer having a single-layered structure may be formed, for example, from a water-soluble resin and a crosslinking agent. The protective layer having a multi-layered structure may be formed, for example, from a water-soluble resin, a crosslinking agent and a pigment.

—Water-Soluble Resin—

Examples of the water-soluble resin include water-soluble polymers such as polyvinyl alcohols, itaconic acid-modified polyvinyl alcohols, maleic acid-modified polyvinyl alcohols, acetoacetyl-modified polyvinyl alcohols, carboxy-modified polyvinyl alcohols, reactive carbonyl group-containing polyvinyl alcohols, amide-modified polyvinyl alcohols, sulfonic acid-modified polyvinyl alcohols, butyral-modified polyvinyl alcohols, olefin-modified polyvinyl alcohols, nitrile-modified polyvinyl alcohols, pyrrolidone-modified polyvinyl alcohols, silicone-modified polyvinyl alcohols, other modified polyvinyl alcohols, starch and derivatives thereof, cellulose derivatives (e.g., methoxy cellulose, hydroxy ethyl cellulose and carboxy methyl cellulose), polyacrylate soda, polyvinyl pyrrolidone, alkali salts of styrene/maleic anhydride copolymers, alkali salts of isobutylene/maleic anhydride copolymers, polyacrylamides, gelatin and casein. Among them, itaconic acid-modified polyvinyl alcohols, maleic acid-modified polyvinyl alcohols and acetoacetyl-modified polyvinyl alcohols are preferred, since the formed thermosensitive recording material can provide a printed image having a sufficient waterproofness and exhibit a head-matching property.

—Maleic Acid-Modified Polyvinyl Alcohol—

The maleic acid-modified polyvinyl alcohol is not particularly limited and can be produced with a conventionally known method.

The carboxyl group content of the maleic acid-modified polyvinyl alcohol is preferably 2 mol % to 10 mol % in consideration of waterproofness. When the carboxyl group content is less than 2 mol %, the formed thermosensitive recording material does not sufficient waterproofness for practical use. Whereas when the carboxyl group content is more than 10 mol %, improvement in waterproofness cannot be obtained and cost elevation is caused. The polymerization degree of the meleic acid-modified polyvinyl alcohol is preferably 300 to 3,000, particularly preferably 500 to 2,200. Also, the saponification degree thereof is preferably 80% or higher.

Furthermore, if necessary, another resin may be added to the maleic acid-modified polyvinyl alcohol. In this case, the another resin may be added in an amount of about 1 part by mass to about 50 parts by mass per 100 parts by mass of the maleic acid-modified polyvinyl alcohol.

Examples of the another resin include polyvinyl alcohol resins, polyvinyl alcohols, diacetone-modified polyvinyl alcohols, sulfonic acid-modified polyvinyl alcohols, silicon-modified polyvinyl alcohols, starch and derivatives thereof; cellulose derivatives (e.g., hydroxyl methyl cellulose, hydroxy ethyl cellulose, carboxy methyl cellulose, methyl cellulose and ethyl cellulose); water-soluble polymers (e.g., polyacrylate soda, polyvinyl pyrrolidone, acrylamide-acrylic acid ester copolymers, acrylamide-acrylic acid ester-methacrylic acid terpolymers, alkali salts of styrene-maleic anhydride copolymers, alkali salts of isobutylene/maleic anhydride copolymers, polyacrylamides, alginate soda, gelatin and casein); emulsions of polyvinyl acetates, polyurethanes, polyacrylic acids, polyacrylates, vinyl chloride-vinyl acetate copolymers, polybutyl methacrylates, ethylene-vinyl acetate copolymers, etc.; latexes of styrene-butadiene copolymers and styrene-butadiene-acryl copolymers. Of these, reactive carbonyl group-containing polyvinyl alcohols are preferred in order for the formed thermosensitive recording material to have high storage stability and improved head-matching property.

—Acetoacetyl-Modified Polyvinyl Alcohol—

The acetoacetyl-modified polyvinyl alcohol is not particularly limited can be produced with a conventionally known method.

The carboxyl group content of the acetoacetyl-modified polyvinyl alcohol is adjusted to about 0.5 mol % to about 20 mol %. In consideration of waterproofness of the formed thermosensitive recording material, it is preferably 2 mol % to 10 mol %. When the carboxyl group content is lower than 2 mol %, the formed thermosensitive recording material does not sufficient waterproofness for practical use. Whereas when the carboxyl group content is more than 10 mol %, improvement in waterproofness cannot be obtained and cost elevation is caused. The polymerization degree of the acetoacetyl-modified polyvinyl alcohol is preferably 300 to 3,000, particularly preferably 500 to 2,200. The saponification degree thereof is preferably 80% or higher.

Furthermore, if necessary, another resin, which is those listed as being added to the maleic acid-modified polyvinyl alcohol, may be added to the acetoacetyl-modified polyvinyl alcohol. In this case, the another resin may be added in an amount of about 1 part by mass to about 50 parts by mass per 100 parts by mass of the acetoacetyl-modified polyvinyl alcohol.

—Crosslinking Agent—

The crosslinking agent is not particularly limited, so long as it can crosslink the components contained in the protective layer, and may be appropriately selected depending on the purpose. Examples thereof include, but not limited to, polyvalent amine compounds such as ethylene diamine; polyvalent aldehyde compounds such as glyoxal, glutalaldehyde and dialdehyde; dihydrazide compounds such as polyamide-eamine-epichlorohydrin, polyamide-epichlorohydrin, dihydrazide adipate and dihydrazide phthalate; water-soluble methylol compounds (urea, melamine and phenol); multifunctional epoxy compounds; multivalent metal salts (e.g., Al, Ti, Zr and Mg); titanium lactate; and boric acid. In addition, these may be combined with other commonly known crosslinking agents.

—Pigment—

Examples of the pigment include inorganic pigments such as aluminum hydroxide, zinc hydroxide, zinc oxide, titanium dioxide, calcium carbonate, silica, alumina, barium sulfate, clay, talc and kaoline. In particular, aluminum hydroxide and calcium carbonate exhibit good wear resistance to the thermal head for a long period of time. Also, known organic pigments may be employed.

When the protective layer is formed so as to have a two-layered structure (first and second protective layers), preferably, a water-soluble resin (binder resin) and a crosslinking agent are added to the first protective layer, and a water-soluble resin (binder resin), a crosslinking agent and a pigment are added to the second protective layer. The water-soluble resin and crosslinking agent contained in the first protective layer may be the same as listed above. The second protective layer is formed of the same material as the above-described single-layered protective layer. In this case, the first protective layer is formed for the purpose of improving storage stability similar to the conventional case, and the second protective layer is formed for the purpose of mainly improving waterproofness of a printed image.

Examples of the pigment contained in the second protective layer include inorganic fine powder such as aluminum hydroxide, calcium carbonate, silica, zinc oxide, titanium oxide, zinc hydroxide, barium sulfate, clay, talc, and surface-treated calcium or silica. In particular, aluminum hydroxide and calcium carbonate, which are basic fillers, are preferred, since they have good wear resistance to the thermal head for a long period of time. Here, aluminum hydroxide and calcium carbonate are in the form of particles, and their volume average particle diameter is not particularly limited. Preferably, it is about 0.1 μm to about 2 μm, in consideration of improvement in head-matching property and/or color-developing property.

Furthermore, silicone resin particles may be incorporated as a basic filler into the uppermost layer which is, for example, the second protective layer. Silicone resin particles are formed by dispersing/curing silicone resin into fine powder, and are classified into spherical microparticles and amorphous powder. The silicone resin may be a polymer containing a three-dimensional network structure with a siloxane bond as a main chain. There can be widely used those having as a side chain a methyl group, a phenyl group, a carboxyl group, a vinyl group, a nitrile group, an alkoxy group and a chlorine atom. In general, the silicone resin having a methyl group is used. The average particle diameter thereof is not particularly limited. Preferably, it is about 0.5 μm to about 10 μm, in consideration of improvement in head-matching property and/or color-developing property.

<Under Layer>

The under layer contains a binder resin and plastic hollow particles; and, if necessary, further contains other components.

—Plastic Hollow Particle—

Each of the plastic hollow particles has a shell made of thermoplastic resin and contains therein air or other gas. They are fine hollow particles already in a foamed state, and the average particle diameter (outer particle diameter) is preferably 0.2 μm to 20 μm, more preferably 2 μm to 5 μm. When the average particle diameter is smaller than 0.2 μm, it is technically difficult to make particles hollow and the function of the under layer becomes insufficient. On the other hand, when the above diameter is greater than 20 μm, the dried coating surface degrades in smoothness. Thus, the coated thermosensitive recording layer becomes non-uniform, and it is required to apply larger amount of thermosensitive recording layer coating liquid than necessary in order to provide a uniform layer. Accordingly, the plastic hollow particles preferably have a sharp distribution peak with little variation as well as an average particle diameter falling within the aforementioned range.

Furthermore, the above-described hollow microparticles preferably have a hollow ratio of 30% to 95%, particularly preferably 80% to 95%. In particles with a hollow ratio of less than 30%, thermal insulating properties are insufficient. Thus, heat energy from the thermal head is emitted to the outside of the thermosensitive recording material via the support, resulting in that the effect of improving sensitivity becomes inadequate. The hollow ratio referred to herein is the ratio of the inner diameter (the diameter of the hollow part) of the hollow particles to the outer diameter, and can be expressed by the following equation:

$$\text{Hollow ratio}=(\text{inner diameter of the hollow particles}/\text{outer diameter of the hollow particles})\times 100$$

As described above, each of the hollow microparticles has a shell of thermoplastic resin. Examples of the thermoplastic resin include styrene-acrylic resins, polystyrene resins, acrylic resins, polyethylene resins, polypropylene resins, polyacetal resins, chlorinated polyether resins, vinyl polychloride resins, and copolymer resins whose main components are vinylidene chloride and acrylonitrile. Also, as thermoplastic materials, examples include phenol formaldehyde resins, urea formaldehyde resins, melamine formaldehyde resins, furan resins, unsaturated polyester resin produced through addition polymerization and crosslinked MMA resin. Of these, styrene/acrylic resin and copolymer resins whose main components are vinylidene chloride and acrylonitrile are suitable for blade coating, since the hollow ratio is high and the variation in particle diameters is small.

The coating amount of the plastic hollow particles needs to be 1 g to 3 g per square meter of the support in order to maintain sensitivity and coating uniformity. When the coating amount is less than 1 $g/m^2$, inadequate sensitivity results. Whereas when the coating amount exceeds 3 $g/m^2$, layer adhesiveness decreases.

<Support>

In the present invention, the shape, structure and size of the support can be appropriately selected in accordance with the intended purpose. The shape of the support may be, for example, a flat board shape, and the structure may be a single-layer structure or a multi-layer structure. The size can be appropriately selected in accordance with the size of the thermosensitive recording materials or the like.

Materials of the support can be appropriately selected in accordance with the objective, and various inorganic materials or organic materials can be used.

—Inorganic Material—

As inorganic materials, examples include glass, quartz, silicon, silicon oxide, aluminum oxide, $SiO_2$ and metals. As organic materials, examples include paper, such as high-quality paper, art paper, coated paper and synthetic paper; cellulose derivatives such as triacetyl cellulose; or polymer film made, for example, of polyethylene terephthalate (PET), polybutylene terephthalate, polycarbonate, polystyrene, polymethyl methacrylate, polyethylene and polypropylene. Among these, high-quality paper, art paper, coated paper and polymer film are preferable. These may be used singly or in combination.

The support is preferably subjected to surface modification treatment such as corona discharge treatment, oxide reaction treatment (by use of chromic acid or the like), etching treatment, adhesion treatment and antistatic treatment and the like for the purpose of improving the adhesiveness of the coating layer. In addition, it is preferable for the support to be whitened through addition of a white pigment such as titanium oxide.

The thickness of the support can be appropriately selected in accordance with the objective, but the thickness is preferably 50 μm to 2,000 μm, more preferably 100 μm to 1,000 μm.

<Other Layers>

<Back Layer>

It is preferable for the thermosensitive recording material of the present invention to have a back layer containing a binder resin, a crosslinking agent and a pigment on the surface of the support on the side opposite to (the back side of) the side on which the thermosensitive color-developing layer is provided. Other components may also be contained in the back layer, such as a filler and a lubricant.

—Binder Resin—

The binder resin may be a water-soluble or water-dispersible resin. Specific examples thereof include commonly known water-soluble polymers and aqueous polymer emulsions.

—Water-Soluble Polymer—

Examples of the water-soluble polymer include polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide/acrylate copolymers, acryl amide/acrylate/methacrylic acid terpolymers, alkali salts of styrene/maleic anhydride copolymers, alkali salts of isobutylene/maleic anhydride copolymers, polyacrylamide, alginate soda, gelatin and casein. These may be used singly or in combination.

—Aqueous Polymer Emulsion—

Examples of the aqueous polymer emulsion include latexes of, for example, acrylate copolymers, styrene/butadiene copolymers and styrene/butadiene/acryl copolymers; and emulsions of, for example, a vinyl acetate resin, vinyl acetate/acrylate copolymers, styrene/acrylate copolymers, acrylate resins and polyurethane resins. These may be used singly or in combination.

—Crosslinking Agent—

The crosslinking agent may be those used for the above-described protective layer.

—Pigment—

The pigment may be those used for the above-described protective layer.

—Filler—

The filler may be an inorganic or organic filler. Examples of the inorganic filler include carbonates, silicates, metal oxides and sulfate compounds. Examples of the organic filler include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins and polymethyl methacrylate resins.

The method of forming the back layer is not particularly limited and may be appropriately selected depending on the purpose. The method of forming the layer by coating the back layer-coating liquid on the support is suitable. The coating method may also be appropriately selected in accordance with the intended purpose; for example, spin coating, dip coating, kneader coating, curtain coating, or blade coating can be used.

The thickness of the back layer may be appropriately selected in accordance with intended purpose, but is preferably 0.1 μm to 10 μm, more preferably 0.5 μm to 5 μm.

[Usage Form of Thermosensitive Recording Material]

A thermosensitive recording label, one of the usage forms of the thermosensitive recording materials, as a first embodiment, includes an adhesive layer and a release paper sequentially provided over the back layer or the back surface of the support of the thermosensitive recording material; and, if necessary, includes other components.

The materials for the adhesive layer can be appropriately selected in accordance with the intended purpose, examples thereof include urea resins, melamine resins, phenol resins, epoxy resins, vinyl acetate resins, vinyl acetate/acrylic copolymers, ethylene/vinyl acetate copolymers, acrylic resins, polyvinyl ether resins, vinyl chloride/vinyl acetate copolymers, polystyrene resins, polyester resins, polyurethane resins, polyamide resins, chlorinated polyolefin resins, polyvinyl butyral resins, acrylate copolymers, methacrylate copolymers, natural rubber, cyanoacrylate resins and silicone resins. These may be used singly or in combination.

As a second embodiment, the thermosensitive recording layer has a thermosensitive adhesive layer which develops adhesiveness by the action of heat and which is laid over the back layer or the back surface of the support of the thermosensitive recording material; and, if necessary, includes other components.

The thermosensitive adhesive layer contains a thermoplastic resin and a hot-melt material; and, if necessary, contains an adhesion-imparting agent. The thermoplastic resin provides the layer with viscosity and adhesiveness. The hot-melt material is a solid at room temperature and thus provides no plasticity. But it melts when heated, allowing the resin to swell and soften, thereby developing adhesiveness. Here, the adhesion-imparting agent has the action of increasing adhesiveness.

Thermosensitive recording magnetic paper, which is another usage form of the thermosensitive recording material, includes a magnetic recording layer over the back layer or the back surface of the support of the thermosensitive recording material; and, if necessary, includes other components.

The magnetic recording layer is formed on the support either by coating method using iron oxide and barium ferrite or the like together with vinyl chloride resin, urethane resin, nylon resin or the like, or by vapor deposition or sputtering without using resins.

The magnetic recording layer is preferably provided on the surface of the support on the side opposite to (the back side of) the side on which the thermosensitive color-developing layer is provided, but may also be provided between the support and the thermosensitive color-developing layer or on a portion of the thermosensitive color-developing layer.

The shape of the thermosensitive recording material of the present invention can be appropriately selected in accordance with the intended purpose, but label shape, sheet shape and roll shape are suitable.

Recording using the thermosensitive recording material of the present invention can be accomplished using a thermal pen, a thermal head, laser heating or the like depending on the usage objective, and there are no particular limitations thereon.

The thermosensitive recording material of the present invention may be suitably used in a variety of fields including POS fields (e.g., labels for perishable foods, box lunches, side dishes); copying field (e.g., documents); communication field (e.g., facsimiles); ticketing field (e.g., ticket-vending machines, receipts); and package tags in the airline industry.

EXAMPLES

The present invention will next be described in detail by way of Examples and Comparative Examples, but the Examples should not be construed as limiting the present invention thereto.

Example 1-1

(1) Preparation of Under Layer-Coating Liquid [Liquid A]

The following components were dispersed with a sand mill to prepare under layer-coating liquid [Liquid A].

[Liquid A]

Hollow spherical plastic microparticles: 36 parts by mass (product of Rohm and Haas Company, Ropaque HP-91 (copolymer resin composed predominantly of styrene-acrylic acid, solid content: 27.5%, volume average particle diameter: 1 μm, hollow ratio: 50%)) Styrene-butadiene copolymer latex (solid content: 47.5%): 10 parts by mass (SMARTEX PA-9159, product of NIPPON A&L INC.)

Water: 54 parts by mass (2) Preparation of Thermosensitive Color-Developing Layer-Coating liquid [Liquid D]

The following components for [Liquid B] were dispersed with a sand mill so as to have a volume average particle diameter of 1.0 μm or smaller, to thereby prepare [Liquid B]; i.e., a dye dispersion liquid. Separately, the following components for [Liquid C] were dispersed with a sand mill so as to have a volume average particle diameter of 1.0 μm or smaller, to thereby prepare [Liquid C]; i.e., a developer dispersion liquid. Subsequently, [Liquid B] and [Liquid C] were mixed with each other at a ratio of 1:7. The resultant mixture was adjusted in solid content to 25%, followed by stirring, to thereby prepare thermosensitive color-developing layer-coating liquid [Liquid D].

[Liquid B]

2-Anilino-3-methyl-6-(di-n-butylamino)fluoran: 20 parts by mass

10% Aqueous solution of itaconic acid-modified polyvinyl alcohol (modification rate: 1 mol %): 20 parts by mass (K polymer KL-318, product of KURARAY Co., LTD.)

Water: 60 parts by mass

[Liquid C]

4-Hydroxy-4'-isopropoxydiphenylsulfone: 20 parts by mass

10% Aqueous solution of itaconic acid-modified polyvinyl alcohol (modification rate: 1 mol %): 20 parts by mass (K polymer KL-318, product of KURARAY Co., LTD.)

Silica: 10 parts by mass (Mizucasile P-527, product of MIZUSAWA INDUSTRIAL CHEMICALS, LTD.; volume average particle diameter: 1.6 μm)

Water: 50 parts by mass (3) Preparation of Protective Layer-Coating Liquid [Liquid F]

The following components were dispersed with a sand mill for 24 hours to prepare [Liquid E].

[Liquid E]

Aluminum hydroxide: 20 parts by mass (Hygilite H-43M, product of SHOWA DENKO K.K., volume average particle diameter: 0.6 μm)

10% Aqueous solution of itaconic acid-modified polyvinyl alcohol (modification rate: 1 mol %): 20 parts by mass (K polymer KL-318, product of KURARAY Co., LTD.)

Water: 60 arts by mass

Subsequently, the following components including [Liquid E] were mixed/stirred to prepare protective layer-coating liquid [Liquid F].

[Liquid F]

[Liquid E]: 75 parts by mass

10% Aqueous solution of itaconic acid-modified polyvinyl alcohol (modification rate: 1 mol %): 100 parts by mass (K polymer KL-318, product of KURARAY Co., LTD.)

25% Aqueous solution of polyamide-epichlorohydrine resin: 20 parts by mass (WS535, product of Seiko PMC Corporation)

Water: 90 parts by mass

<Production of Thermosensitive Recording Material>

The under layer-coating liquid [Liquid A] was applied through blade coating onto a base paper support (high-quality paper having a basis weight of about 60 g/m$^2$) so that the deposition amount after drying was 3.0 g/m$^2$, followed by drying, to thereby form an under layer. Subsequently, the thermosensitive color-developing layer-coating liquid [Liquid D] and the protective layer-coating liquid [Liquid F] were simultaneously applied with a curtain coater at a rate of 600 m/min onto the under layer so that the deposition amounts after drying were respectively 5.0 g/m$^2$ and 3.0 g/m$^2$, followed by drying. Thereafter, the resultant product was subjected to calendering so that the Oken-type smoothness of the surface was about 2,000 sec, to thereby produce a thermosensitive recording material of Example 1-1.

Example 1-2

(3-1) Preparation of First Protective Layer-Coating Liquid [Liquid G]

The following components were mixed/stirred to prepare first protective layer-coating liquid [Liquid G].

[Liquid G]

10% Aqueous solution of itaconic acid-modified polyvinyl alcohol (modification rate: 1 mol %): 100 parts by mass (K polymer KL-318, product of KURARAY Co., LTD.)
25% Aqueous solution of polyamide-epichlorohydrine resin: 30 parts by mass
(WS535, product of Seiko PMC Corporation)
Water: 100 parts by mass
<Production of Thermosensitive Recording Material>

In this Example, [Liquid F] was used as a second protective layer-coating liquid. First, an under layer was formed on a base paper support in the same manner as in Example 1-1. Subsequently, thermosensitive color-developing layer-coating liquid [Liquid D], first protective layer-coating liquid [Liquid G] and second protective layer-coating liquid [Liquid F] were simultaneously applied with a curtain coater at a rate of 600 m/min onto the under layer so that the deposition amounts after drying were respectively 5.0 g/m$^2$, 1.0 g/m$^2$ and 1.0 g/m$^2$, followed by drying. Thereafter, the resultant product was subjected to calendering so that the Oken-type smoothness of the surface was about 2,000 sec, to thereby produce a thermosensitive recording material of Example 1-2.

Example 1-3

<Production of Thermosensitive Recording Material>

First, an under layer was formed on a base paper support in the same manner as in Example 1-1. Subsequently, thermosensitive color-developing layer-coating liquid [Liquid D] and first protective layer-coating liquid [Liquid G] were simultaneously applied with a curtain coater at a rate of 600 m/min onto the under layer so that the deposition amounts after drying were respectively 5.0 g/m$^2$ and 1.0 g/m$^2$, followed by drying. Thereafter, [Liquid F] serving as a second protective layer-coating liquid was applied through blade coating onto the resultant product so that the deposition amount after drying was 1.0 g/m$^2$, followed by drying. Furthermore, the resultant product was subjected to calendering so that the Oken-type smoothness of the surface was about 2,000 sec, to thereby produce a thermosensitive recording material of Example 1-3.

Example 1-4

(3-2) Preparation of Second Protective Layer-Coating Liquid [Liquid H]

The following components were mixed/stirred to prepare second protective layer-coating liquid [Liquid H].
[Liquid H]
[Liquid E]: 75 parts by mass
10% Aqueous solution of itaconic acid-modified polyvinyl alcohol (modification rate: 1 mol %): 100 parts by mass
(K polymer KL-318, product of KURARAY Co., LTD.)
25% Aqueous solution of polyamide-epichlorohydrine resin: 20 parts by mass
(WS535, product of Seiko PMC Corporation)
Silicone resin particles (TOSPEARL 120A, Momentive Performance Materials Inc.): 0.5 parts by mass
Water: 100 parts by mass
<Production of Thermosensitive Recording Material>

The procedure of Example 1-2 was repeated, except that [Liquid F] was changed to [Liquid H], to thereby prepare a thermosensitive recording material of Example 1-4.

Example 1-5

<Production of Thermosensitive Recording Material>

The procedure of Example 1-3 was repeated, except that [Liquid F] was changed to [Liquid H], to thereby prepare a thermosensitive recording material of Example 1-5.

Example 1-6

<Production of Thermosensitive Recording Material>

The procedure of Example 1-4 was repeated, except that the hollow spherical plastic microparticles contained in [Liquid A] were changed to a vinyliden chloride/acrylonitrile copolymer (MICROSPHERE, product of Matsumoto Yushi-Seiyaku Co., Ltd., mole ratio of vinyliden chloride/acrylonitrile=6/4, solid content: 27.5%, volume average particle diameter: 3 μm, hollow ratio: 90%), to thereby produce a thermosensitive recording material of Example 1-6.

Example 1-7

(4) Preparation of Back Layer-Coating Liquid [Liquid I]

The following components were mixed/stirred to prepare back layer-coating liquid [Liquid I].
[Liquid E]: 50 parts by mass
10% Aqueous solution of polyvinyl alcohol: 100 parts by mass
(KURARAY POVAL PVA-117, product of KURARAY Co., LTD.)
10% Aqueous solution of polyamide-epichlorohydrine resin: 30 parts by mass
(WS535, product of Seiko PMC Corporation)
Water: 100 parts by mass
<Production of Thermosensitive Recording Material>

The procedure of Example 1-4 was repeated, except that [Liquid I] was applied through blade coating on a surface of the support, the surface being that of the support on the side opposite to the side where the thermosensitive color-developing layer was provided, so that the deposition amount after drying was 1.5 g/mm$^2$, to thereby produce a thermosensitive recording material of Example 1-7.

Example 1-8

An acrylic adhesive (AT-1202, product of Saiden Chemical Industry Co., Ltd.) was applied onto a release paper (LSW, product of Lintec Corporation) so that the deposition amount after drying was 20 g/m$^2$, followed by drying. Subsequently, the thermosensitive recording paper of Example 1-4 was attached thereto, to thereby produce an adhesive label. The thus-produced adhesive label was punched out so as to have a size of 40 mm×60 mm. The thus-punched adhesive label having a length equivalent to 100 labels was wound around a 1-inch paper tube to form a small roll.

The small roll was set in HC-6200 (full auto printer, product of TERAOKASEIKO, CO., LTD), followed by continuous printing/attaching of each label. As a result, printing/attaching could be performed with no problems.

Example 1-9

A thermosensitive adhesive (DT-200, product of Resitex Co., solid content: 58%) was applied onto a surface of the thermosensitive recording material of Example 1-4, the surface being that of the support on the side opposite to the side where the thermosensitive color-developing layer was provided, so that the deposition amount after drying was 25 g/m$^2$, followed by drying, to thereby form a thermosensitive adhesive layer. Through the above procedure, a thermosensitive adhesive label was obtained.

The thermosensitive label was cut into pieces each having a size of 4 cm×10 cm, and the cut pieces were printed with a printer (SM-90) (product of TERAOKASEIKO, CO., LTD). Subsequently, the thermosensitive adhesive layer surface was activated using a thermal head (TH-0976SP, product of TEC Co.) and a platen roll having a diameter of 1 cm. Here, the thermal head was driven at 8 dot/mm, while electric current was being applied to all the dots thereof, under the following conditions: resistance: 500 Ω; activation energy: 26.0 mJ/mm$^2$ and printing speed: 100 mm/sec. Also, the pressure of the platen roll was set to 6 kgf/line. As a result, printing/attaching could be performed with no problems.

Example 1-10

<Preparation of Coating Liquid for Forming Magnetic Recording Layer>

The following components were homogenously mixed to prepare a coating liquid for forming a magnetic recording layer. Barium ferrite: 100 parts by mass
(MC127, product of TODA KOGYO CORP., solid)
Sodium polycarboxylate: 5 parts by mass
(Aron T-40, product of TOAGOSEI CO., LTD., solid)
Aqueous latex of polyurethane resin: 30 parts by mass
(UD-500, product of Mitsui Chemicals, Inc., solid)
Water: 200 parts by mass The above-prepared coating liquid was applied onto one surface of a support: a paper having a basis weight of 160 g/m$^2$, in an amount of 30 g (dry)/m$^2$, followed by magnetic field orientation. Subsequently, the support was dried at 110° C. to form a magnetic recording layer. Thereafter, the other surface of the support was provided with a thermosensitive recording layer in the same manner as in Example 1-4, to thereby form a thermosensitive recording type magnetic ticket paper. The thus-formed ticket paper could be discharged from a ticket-vending machine (product of TAKAMIZAWA CYBERNETICS COMPANY, LTD.) with no problems.

Comparative Example 1-1

<Production of Thermosensitive Recording Material>

The procedure of Example 1-1 was repeated, except that the thermosensitive color-developing layer-coating liquid and the protective layer-coating liquid were applied with a mayer bar, to thereby produce a thermosensitive recording material of Comparative Example 1-1.

Comparative Example 1-2

<Production of Thermosensitive Recording Material>

The procedure of Example 1-1 was repeated, except that the thermosensitive color-developing layer-coating liquid and the protective layer-coating liquid were applied with a rod bar, to thereby produce a thermosensitive recording material of Comparative Example 1-2.

Each of the thus-produced thermosensitive recording materials of Examples 1-1 to 1-7 and Comparative Examples 1-1 and 1-2 was evaluated for various properties. The results are shown in Table 1.

<Relative Sensitivity>

Each thermosensitive recording material was tested using a thermosensitive printing experimental apparatus having a thin film head (product of Matsushita Electronic Components, Co., Ltd.) under the following conditions: electrical power of head: 0.45 W/dot; recording time per line: 20 msec/L; and scanning density: 8×385 dot/mm. Here, the thermosensitive recording material was printed with the pulse width being changed from 0.2 msec to 1.2 msec in increments of 0.1 msec, and was measured for printed image density with a Macbeth densitometer RD-914. Then, the pulse width at which the density was 1.0 was calculated.

The relative sensitivity for each sample was calculated using the following formula based on the value of Comparative Example 1-1. Notably, the greater the value, the higher the sensitivity (thermal responsiveness), and the sample exhibiting a greater value is good.

Relative sensitivity=(pulse width of the sample of Comparative Example 1-1)/(pulse width of the sample measured)

<Plasticizer Resistance>

Each thermosensitive recording material was brought into contact with a hot stamp at 150° C. for 1 sec. After color development, three vinyl chloride wrap sheets were overlaid on the thermosensitive color-developing layer of the thermosensitive recording material. The thus-obtained thermosensitive recording material was stored for 15 hours at 40° C. under dry conditions while a load of 5 kg/100 cm$^2$ was being applied thereon. After storing, the thermosensitive recording material was measured for an image density with a Macbeth densitometer (model RD-914, product of Macbeth Co.).

<Plasticizer Resistance of Back Surface>

Each thermosensitive recording material was brought into contact with a hot stamp at 150° C. for 1 sec. After color development, three vinyl chloride wrap sheets were overlaid on the back surface of the thermosensitive recording material (i.e., the surface of the support on the side opposite to the side where the thermosensitive color-developing layer was provided). The thus-obtained thermosensitive recording material was stored for 15 hours at 50° C. under dry conditions while a load of 5 kg/100 cm$^2$ was being applied thereon. After storing, the thermosensitive recording material was measured for an image density with a Macbeth densitometer (model RD-914, product of Macbeth Co.).

<Sticking Property>

Each thermosensitive recording material (medium) was printed with a TM-T88II printer (product of SEIKO EPSON CORPORATION) at a temperature of 23° C. and relative humidity of 65%, and evaluated for the volume of sound by attachment of the thermal head to the thermosensitive recording medium during printing. The evaluation criteria are given below.

A: No sound by attachment therebetween
B: Almost no sound by attachment therebetween
C: Slight sound by attachment therebetween
D: Considerable sound by attachment therebetween <Dot Reproducibility>

The image of each thermosensitive recording material obtained after the above relative sensitivity test was visually evaluated for dot reproducibility. The evaluation criteria are given below.

A: Excellent
B: Good
C: Normal
D: Bad

TABLE 1

| | Relative sensitivity | Plasticizer resistance | Back surface-plasticizer resistance | Sticking | Dot reproducibility |
|---|---|---|---|---|---|
| Ex. 1-1 | 1.01 | 1.23 | 1.20 | C | B |
| Ex. 1-2 | 1.02 | 1.28 | 1.20 | C | B |
| Ex. 1-3 | 1.02 | 1.28 | 1.19 | B | B |
| Ex. 1-4 | 1.02 | 1.28 | 1.20 | B | B |
| Ex. 1-5 | 1.02 | 1.30 | 1.20 | A | B |
| Ex. 1-6 | 1.05 | 1.28 | 1.21 | B | A |

TABLE 1-continued

| | Relative sensitivity | Plasticizer resistance | Back surface-plasticizer resistance | Sticking | Dot reproducibility |
|---|---|---|---|---|---|
| Ex. 1-7 | 1.02 | 1.25 | 1.25 | B | B |
| Comp. Ex. 1-1 | 1.00 | 1.15 | 1.19 | B | D |
| Comp. Ex. 1-2 | 1.00 | 1.22 | 1.19 | B | C |

Example 2-1

<Production of Thermosensitive Recording Material>

(1) Preparation of Under Layer-Coating Liquid

The following components were mixed/stirred to prepare under layer-coating liquid [Liquid A].

[Liquid A]

Hollow spherical plastic microparticles: 36 parts by mass (product of Rohm and Haas Company, Ropaque HP-91 (copolymer resin composed predominantly of styrene-acrylic acid, solid content: 27.5%, volume average particle diameter: 1 μm, hollow ratio: 50%)) Styrene-butadiene copolymer latex: 10 parts by mass (SMARTEX PA-9159, product of NIPPON A&L INC., solid content: 47.5%)

Water: 54 parts by mass (2) Preparation of Thermosensitive Color-Developing Layer-Coating Liquid [Liquid D]

The following components for [Liquid B] were dispersed with a sand mill so as to have a volume average particle diameter of 1.0 μm or smaller, to thereby prepare [Liquid B]; i.e., a dye dispersion liquid. Separately, the following components for [Liquid C] were dispersed with a sand mill so as to have a volume average particle diameter of 1.0 μm or smaller, to thereby prepare [Liquid C]; i.e., a developer dispersion liquid. Subsequently, [Liquid B] and [Liquid C] were mixed with each other at a ratio of 1:7. The resultant mixture was adjusted in solid content to 25%, followed by stirring, to thereby prepare thermosensitive color-developing layer-coating liquid [Liquid D].

[Liquid B]

2-Anilino-3-methyl-6-(di-n-butylamino)fluoran: 20 parts by mass

10% Aqueous solution of itaconic acid-modified polyvinyl alcohol: 20 parts by mass (KL-318, modification rate: 1 mol %, product of KURARAY Co., LTD.)

Water: 60 parts by mass

[Liquid C]

4-Hydroxy-4'-isopropoxydiphenylsulfone: 20 parts by mass

10% Aqueous solution of itaconic acid-modified polyvinyl alcohol: 20 parts by mass (KL-318, modification rate: 1 mol %, product of KURARAY Co., LTD.)

Silica: 10 parts by mass (Mizucasile P-603, product of MIZUSAWA INDUSTRIAL CHEMICALS, LTD., volume average particle diameter: 3 μm)

Water: 50 parts by mass (3) Preparation of First Protective Layer-Coating Liquid [Liquid E]

The following components were mixed/stirred to prepare first protective layer-coating liquid [Liquid E].

[Liquid E]

10% Aqueous solution of diacetone-modified polyvinyl alcohol: 100 parts by mass (D-700VH, product of JAPAN VAM & POVAL CO., LTD.)

10% Aqueous solution of adipic acid dihydrazide: 10 parts by mass (4) Preparation of Second Protective Layer-Coating Liquid [Liquid G]

The following components for [Liquid F] were dispersed with a sand mill for 24 hours to prepare [Liquid F]. Subsequently, the following components for [Liquid G] including the thus-prepared [Liquid F] were mixed/stirred to prepare second protective layer-coating liquid [Liquid G].

[Liquid F]

Aluminum hydroxide: 20 parts by mass (Hygilite H-43M, product of SHOWA DENKO K.K., volume average particle diameter: 0.6 μm)

10% Aqueous solution of itaconic acid-modified polyvinyl alcohol: 20 parts by mass (KL-318, modification rate: 1 mol %, product of KURARAY Co., LTD.)

Water: 60 parts by mass

[Liquid G]

[Liquid F]: 75 parts by mass

10% Aqueous solution of maleic acid-modified polyvinyl alcohol: 100 parts by mass (KM-618, product of KURARAY Co., LTD.)

10% Aqueous solution of polyamide-epichlorohydrine resin: 30 parts by mass (WS535 (trade name), product of Seiko PMC Corporation)

Water: 90 parts by mass

The above-prepared [Liquid A] was applied through blade coating onto a base paper support (high-quality paper having a basis weight of about 60 g/m$^2$) so that the deposition amount after drying was 3.0 g/m$^2$, followed by drying, to thereby form an under layer. Subsequently, the thermosensitive color-developing layer-coating liquid [Liquid D], the first protective layer-coating liquid [Liquid E] and the second protective layer-coating liquid [Liquid G] were simultaneously applied with a curtain coater at a rate of 600 m/min onto the under layer so that the deposition amounts after drying were respectively 5.0 g/m$^2$, 1.0 g/m$^2$ and 1.0 g/m$^2$, followed by drying. Thereafter, the resultant product was subjected to calendering so that the Oken-type smoothness of the surface was about 2,000 sec, to thereby produce a thermosensitive recording material of Example 2-1.

Example 2-2

—Production of Thermosensitive Recording Material—

The following components were mixed/stirred to prepare first protective layer-coating liquid [Liquid H]. Subsequently, the procedure of Example 2-1 was repeated, except that [Liquid E] was changed to [Liquid H], to thereby produce a thermosensitive recording material of Example 2-2.

[Liquid H]

10% Aqueous solution of maleic acid-modified polyvinyl alcohol: 100 parts by mass (KM-618, product of KURARAY Co., LTD.)

10% Aqueous solution of polyamide-epichlorohydrine resin: 30 parts by mass
(WS535 (trade name), product of Seiko PMC Corporation)
Water: 100 parts by mass Example 2-3

—Production of Thermosensitive Recording Material—

The procedure of Example 2-2 was repeated, except that aluminum hydroxide contained in [Liquid F] was changed to calcium carbonate (CALSHITEC Brilliant-15, product of SHIRAISHI KOGYO KAISHA, LTD., volume average particle diameter: 0.5 μm), to thereby produce a thermosensitive recording material of Example 2-3.

Example 2-4

—Production of Thermosensitive Recording Material—

The procedure of Example 2-3 was repeated, except that the hollow spherical plastic microparticles contained in [Liquid A] were changed to a vinyliden chloride/acrylonitrile copolymer (mole ratio of vinyliden chloride/acrylonitrile=6/4, solid content: 27.5%, volume average particle diameter: 3 μm, hollow ratio: 90%), to thereby produce a thermosensitive recording material of Example 2-4.

Example 2-5

—Production of Thermosensitive Recording Material—

(4) Preparation of Back Layer-Coating Liquid

The following components were mixed/stirred to prepare a back layer-coating liquid.

[Liquid F]: 50 parts by mass
10% Aqueous solution of polyvinyl alcohol: 100 parts by mass
(RFM-17, product of KURARAY Co., LTD.)
10% Aqueous solution of polyamide-epichlorohydrine: 30 parts by mass
(WS535 (trade name), product of Seiko PMC Corporation)
Water: 100 parts by mass The procedure of Example 2-3 was repeated, except that the thus-prepared back layer-coating liquid was applied through blade coating on a surface of the support, the surface being that of the support on the side opposite to the side where the thermosensitive color-developing layer was provided, so that the deposition amount after drying was 1.5 g/mm$^2$, to thereby produce a thermosensitive recording material of Example 2-5.

Example 2-6

An acrylic adhesive (AT-1202, product of Saiden Chemical Industry Co., Ltd.) was applied onto a release paper (LSW, product of Lintec Corporation) so that the deposition amount after drying was 20 g/m$^2$, followed by drying. Subsequently, the thermosensitive recording paper of Example 2-4 was attached thereto, to thereby produce an adhesive label. The thus-produced adhesive label was punched out so as to have a size of 40 mm×60 mm. The thus-punched adhesive label having a length equivalent to 100 labels was wound around a 1-inch paper tube to form a small roll.

The small roll was set in HC-6200 (full auto printer, product of TERAOKASEIKO, CO., LTD), followed by continuous printing/attaching of each label. As a result, printing/attaching could be performed with no problems.

Example 2-7

A thermosensitive adhesive (DT-200, product of Resitex Co., solid content: 58%) was applied onto a surface of the thermosensitive recording material of Example 2-4, the surface being that of the support on the side opposite to the side where the thermosensitive color-developing layer was provided, so that the deposition amount after drying was 25 g/m$^2$, followed by drying, to thereby form a thermosensitive adhesive layer. Through the above procedure, a thermosensitive adhesive label was obtained.

The thermosensitive label was cut into pieces each having a size of 4 cm×10 cm, and the cut pieces were printed with a printer (SM-90) (product of TERAOKASEIKO, CO., LTD). Subsequently, the thermosensitive adhesive layer surface was activated using a thermal head (TH-0976SP, product of TEC Co.) and a platen roll having a diameter of 1 cm. Here, the thermal head was driven at 8 dot/mm, while electric current was being applied to all the dots thereof, under the following conditions: resistance: 500 Ω; activation energy: 26.0 mJ/mm$^2$ and printing speed: 100 mm/sec. Also, the pressure of the platen roll was set to 6 kgf/line. As a result, printing/attaching could be performed with no problems.

Example 2-8

<Preparation of Coating Liquid for Forming Magnetic Recording Layer>

The following components were homogenously mixed to prepare a coating liquid for forming a magnetic recording layer.

Barium ferrite (MC127, product of TODA KOGYO CORP., solid): 100 parts by mass
Sodium polycarboxylate (Aron T-40, product of TOAGOSEI CO., LTD., solid): 5 parts by mass
Aqueous latex of polyurethane resin (UD-500, product of Mitsui Chemicals, Inc., solid): 30 parts by mass
Water: 200 parts by mass The above-prepared coating liquid was applied onto one surface of a support: a paper having a basis weight of 160 g/m$^2$, in an amount of 30 g (dry)/m$^2$, followed by magnetic field orientation. Subsequently, the support was dried at 110° C. to form a magnetic recording layer. Thereafter, the other surface of the support was provided with a thermosensitive recording layer in the same manner as in Example 2-4, to thereby form a thermosensitive recording type magnetic ticket paper. The thus-formed ticket paper could be discharged from a ticket-vending machine (product of TAKAMIZAWA CYBERNETICS COMPANY, LTD.) with no problems.

Comparative Example 2-1

—Production of Thermosensitive Recording Material—

The procedure of Example 2-1 was repeated, except that the 10% aqueous solution of maleic acid-modified polyvinyl alcohol and the 10% aqueous solution of polyamide-epichlorohydrine resin, which had been used for forming the second protective layer, were changed respectively to 10% aqueous solution of diacetone-modified polyvinyl alcohol (D-700VH, product of JAPAN VAM & POVAL CO., LTD.) and 10% aqueous solution of dihydrazide adipate, to thereby produce a thermosensitive recording material of Comparative Example 2-1.

Comparative Example 2-2

—Production of Thermosensitive Recording Material—

The procedure of Example 2-1 was repeated, except that the thermosensitive color-developing layer-coating liquid, the first protective layer-coating liquid and the second protective layer-coating liquid were applied with a rod bar, to thereby produce a thermosensitive recording material of Comparative Example 2-2.

Comparative Example 2-3

The procedure of Example 2-2 was repeated, except that the coating rate was changed from 600 m/min to 300 m/min, to thereby produce a thermosensitive recording material of Comparative Example 2-3.

Comparative Example 2-4

The procedure of Example 2-1 was repeated, except that the first protective layer-coating liquid [Liquid E] was not applied, and that the second protective layer-coating liquid [Liquid G] was applied so that the deposition amount after drying was 2.0 g/m$^2$, to thereby produce a thermosensitive recording material of Comparative Example 2-4.

Each of the thus-produced thermosensitive recording materials was evaluated for various properties. The results are shown in Table 2.

<Relative Sensitivity>

Each thermosensitive recording material was evaluated in the same manner as described above, except that the value of Comparative Example 2-1 was used as a reference value.

<Evaluation of Waterproofness Against Aqueous Flexographic Printing>

Aqueous flexographic ink (MTQ 30302-404, product of AKZO Nobel) which had been diluted to 25% was applied onto each thermosensitive recording material using a wire bar with a wire diameter of 0.10, and was then dried for one hour in an atmosphere of 23° C. and 50% relative humidity. Thereafter, one drop of water was dropped onto the printed image, and five minutes later, the image was strongly rubbed one time by a finger. In this manner, the thermosensitive recording material was evaluated for waterproofness based on how the printed image peeled off.

The evaluation criteria for waterproofness against aqueous flexographic ink are as follows:

A: No peeling in the printed image

B: Less than 25% peeling occurred in the printed image

C: 25% or more but less than 50% peeling occurred in the printed image

D: 50% or more peeling occurred in the printed image

<Plasticizer Resistance>

Each thermosensitive recording material was evaluated for plasticizer resistance in the same manner as described above.

<Plasticizer Resistance of Back Surface>

Each thermosensitive recording material was evaluated for plasticizer resistance of the back surface in the same manner as described above.

<Dot Reproducibility>

Each thermosensitive recording material was evaluated for dot reproducibility in the same manner as described above.

TABLE 2

| | Relative sensitivity | Peeling by aqueous flexographic ink | Plasticizer resistance | Plasticizer resistance of back surface | Dot reproduciblity |
|---|---|---|---|---|---|
| Ex. 2-1 | 1.00 | A | 1.25 | 1.22 | B |
| Ex. 2-2 | 1.01 | A | 1.24 | 1.21 | B |
| Ex. 2-3 | 1.00 | A | 1.25 | 1.22 | B |
| Ex. 2-4 | 1.14 | A | 1.25 | 1.22 | A |
| Ex. 2-5 | 1.00 | A | 1.24 | 1.27 | B |

TABLE 2-continued

| | Relative sensitivity | Peeling by aqueous flexographic ink | Plasticizer resistance | Plasticizer resistance of back surface | Dot reproduciblity |
|---|---|---|---|---|---|
| Comp. Ex. 2-1 | 1.00 | D | 1.25 | 1.21 | B |
| Comp. Ex. 2-2 | 0.93 | D | 1.15 | 1.22 | B |
| Comp. Ex. 2-3 | 0.93 | D | 1.20 | 1.21 | B |
| Comp. Ex. 2-4 | 0.97 | A | 1.05 | 1.21 | B |

As is clear from Table 2, the thermosensitive recording material of Comparative Example 2-1, containing a diacetone-modified polyvinyl alcohol in the second protective layer, was found to exhibit no improvement in waterproofness against aqueous flexographic printing. The thermosensitive recording materials of Examples, which had been produced by a curtain coating method at a coating rate of as fast as 600 m/min, were found to provide printed images excellent in waterproofness while maintaining high sensitivity and high storage stability. The thermosensitive recording material of Comparative Example 2-2, in which the layers had been formed with a rod bar, was found to considerably degrade in relative sensitivity, waterproofness against aqueous flexographic printing, and plasticizer resistance. As in Comparative Example 2-3, even when the coating rate was decreased to 300 m/min, improved results were not found to be obtained, indicating that the thermosensitive recording material of the present invention is quite suitable for high-speed coating. Notably, the difference in plasticizer is resistance was about 0.10 between Examples and Comparative Example 2-2, which value is very large and significant in such thermosensitive recording materials. Also, the thermosensitive recording material of Comparative Example 2-4, having a protective layer with a single-layered structure, was found to degrade in plasticizer resistance.

Example 3-1

<Production of Thermosensitive Recording Material>

(1) Preparation of Under Layer-Coating Liquid

The following components were mixed/stirred to prepare under layer-coating liquid [Liquid A].

[Liquid A]

Hollow spherical plastic microparticles: 36 parts by mass (product of Rohm and Haas Company, Ropaque HP-91 (copolymer resin composed predominantly of styrene-acrylic acid, solid content: 27.5%, volume average particle diameter: 1 μm, hollow ratio: 50%)) Styrene-butadiene copolymer latex: 10 parts by mass (SMARTEX PA-9159, product of NIPPON A&L INC., solid content: 47.5%)

Water: 54 parts by mass (2) Preparation of Thermosensitive Color-Developing Layer-Coating Liquid [Liquid D]

The following components for [Liquid B] were dispersed with a sand mill so as to have a volume average particle diameter of 1.0 μm or smaller, to thereby prepare [Liquid B]; i.e., a dye dispersion liquid. Separately, the following components for [Liquid C] were dispersed with a sand mill so as to have a volume average particle diameter of 1.0 μm or smaller, to thereby prepare [Liquid C]; i.e., a developer dispersion liquid. Subsequently, [Liquid B] and [Liquid C] were mixed with each other at a ratio of 1:7. The resultant mixture was adjusted in solid content to 25%, followed by stirring, to thereby prepare thermosensitive color-developing layer-coating liquid [Liquid D].

[Liquid B]

2-Anilino-3-methyl-6-(di-n-butylamino)fluoran: 20 parts by mass

10% Aqueous solution of itaconic acid-modified polyvinyl alcohol: 20 parts by mass (KL-318, modification rate: 1 mol %, product of KURARAY Co., LTD.)

Water: 60 parts by mass

[Liquid C]

4-Hydroxy-4'-isopropoxydiphenylsulfone: 20 parts by mass

10% Aqueous solution of itaconic acid-modified polyvinyl alcohol: 20 parts by mass (KL-318, modification rate: 1 mol %, product of KURARAY Co., LTD.)

Silica: 10 parts by mass (Mizucasile P-603, product of MIZUSAWA INDUSTRIAL CHEMICALS, LTD., volume average particle diameter: 3 μm)

Water: 50 parts by mass (3) Preparation of First Protective Layer-Coating Liquid

[Liquid E]

The following components were mixed/stirred to prepare first protective layer-coating liquid [Liquid E].

[Liquid E]

10% Aqueous solution of itaconic acid-modified polyvinyl alcohol: 100 parts by mass (KL-318, modification rate: 1 mol %, product of KURARAY Co., LTD.)

10% Aqueous solution of polyamide-epichlorohydrine resin: 30 parts by mass (WS535 (trade name), product of Seiko PMC Corporation)

(4) Preparation of Second Protective Layer-Coating Liquid

The following components for [Liquid F] were dispersed with a sand mill for 24 hours to prepare [Liquid F]. Subsequently, the following components for [Liquid G] including the thus-prepared [Liquid F] were mixed/stirred to prepare second protective layer-coating liquid [Liquid G].

[Liquid F]

Aluminum hydroxide: 20 parts by mass (Hygilite H-43M, product of SHOWA DENKO K.K., volume average particle diameter: 0.6 μm)

10% Aqueous solution of itaconic acid-modified polyvinyl alcohol: 20 parts by mass (KL-318, modification rate: 1 mol %, product of KURARAY Co., LTD.)

Water: 60 parts by mass

[Liquid G]

[Liquid F]: 75 parts by mass

10% Aqueous solution of acetoacetyl-modified polyvinyl alcohol: 100 parts by mass (GOSEFIMER Z-200, product of Nippon Synthetic Chemical Industry Co., Ltd.)

40% Aqueous solution of glyoxazole (product of Mitsui Chemicals, Inc.): 30 parts by mass Water: 90 parts by mass The above-prepared [Liquid A] was applied through blade coating onto a base paper support (high-quality paper having a basis weight of about 60 g/m$^2$) so that the deposition amount after drying was 3.0 g/m$^2$, followed by drying, to thereby form an under layer.

Subsequently, the thermosensitive color-developing layer-coating liquid [Liquid D], the first protective layer-coating liquid [Liquid E] and the second protective layer-coating liquid is [Liquid G] were simultaneously applied with a curtain coater at a rate of 600 m/min onto the under layer so that the deposition amounts after drying were respectively 5.0 g/m$^2$, 1.0 g/m$^2$ and 1.0 g/m$^2$, followed by drying. Thereafter, the resultant product was subjected to calendering so that the Oken-type smoothness of the surface was about 2,000 sec, to thereby produce a thermosensitive recording material of Example 3-1.

Example 3-2

—Production of Thermosensitive Recording Material—

The following components were mixed/stirred to prepare first protective layer-coating liquid [Liquid H].

The procedure of Example 3-1 was repeated, except that [Liquid E] was changed to [Liquid H], to thereby produce a thermosensitive recording material of Example 3-2.

[Liquid H]

10% Aqueous solution of acetoacetyl-modified polyvinyl alcohol: 100 parts by mass (GOSEFIMER Z-200, product of Nippon Synthetic Chemical Industry Co., Ltd.)

40% Aqueous solution of glyoxazole (product of Mitsui Chemicals, Inc.): 30 parts by mass Water: 100 parts by mass Example 3-3

—Production of Thermosensitive Recording Material—

The procedure of Example 3-2 was repeated, except that aluminum hydroxide contained in [Liquid F] was changed to calcium carbonate (CALSHITEC Brilliant-15, product of SHIRAISHI KOGYO KAISHA, LTD., volume average particle diameter: 0.5 μm), to thereby produce a thermosensitive recording material of Example 3-3.

Example 3-4

—Production of Thermosensitive Recording Material—

The procedure of Example 3-2 was repeated, except that a room-temperature-curable silicone resin (product name: SE 1980 (product of Dow Corning Toray), solid content: 45%) (0.5 parts) was additionally added to [Liquid G], to thereby produce a thermosensitive recording material of Example 3-4.

Example 3-5

—Production of Thermosensitive Recording Material—

The procedure of Example 3-3 was repeated, except that the hollow spherical plastic microparticles contained in [Liquid A] were changed to a vinyliden chloride/acrylonitrile copolymer (mole ratio of vinyliden chloride/acrylonitrile=6/4, solid content: 27.5%, volume average particle diameter: 3 μm, hollow ratio: 90%), to thereby produce a thermosensitive recording material of Example 3-5.

Example 3-6

—Production of Thermosensitive Recording Material—

(4) Preparation of Back Layer-Coating Liquid

The following components were mixed/stirred to prepare a back layer-coating liquid.

[Liquid F]: 50 parts by mass

10% Aqueous solution of polyvinyl alcohol (RFM-17, product of KURARAY Co., LTD.): 100 parts by mass 10% Aqueous solution of polyamide-epichlorohydrine: 30 parts by mass (WS535 (trade name), product of Seiko PMC Corporation)
Water: 100 parts by mass The procedure of Example 3-3 was repeated, except that the thus-prepared back layer-coating liquid was applied through blade coating on a surface of the support, the surface being that of the support on the side opposite to the side where the thermosensitive color-developing layer was provided, so that the deposition amount after drying was 1.5 g/mm$^2$, to thereby produce a thermosensitive recording material of Example 3-6.

Example 3-7

An acrylic adhesive (AT-1202, product of Saiden Chemical Industry Co., Ltd.) was applied onto a release paper (LSW, product of Lintec Corporation) so that the deposition amount after drying was 20 g/m$^2$, followed by drying. Subsequently, the thermosensitive recording paper of Example 3-5 was attached thereto, to thereby produce an adhesive label. The thus-produced adhesive label was punched out so as to have a size of 40 mm×60 mm. The thus-punched adhesive label having a length equivalent to 100 labels was wound around a 1-inch paper tube to form a small roll.

The small roll was set in HC-6200 (full auto printer, product of TERAOKASEIKO, CO., LTD), followed by continuous printing/attaching of each label. As a result, printing/attaching could be performed with no problems.

Example 3-8

A thermosensitive adhesive (DT-200, product of Resitex Co., solid content: 58%) was applied onto a surface of the thermosensitive recording material of Example 3-5, the surface being that of the support on the side opposite to the side where the thermosensitive color-developing layer was provided, so that the deposition amount after drying was 25 g/m$^2$, followed by drying, to thereby form a thermosensitive adhesive layer. Through the above procedure, a thermosensitive adhesive label was obtained.

The thermosensitive label was cut into pieces each having a size of 4 cm×10 cm, and the cut pieces were printed with a printer (SM-90) (product of TERAOKASEIKO, CO., LTD). Subsequently, the thermosensitive adhesive layer surface was activated using a thermal head (TH-0976SP, product of TEC Co.) and a platen roll having a diameter of 1 cm. Here, the thermal head was driven at 8 dot/mm, while electric current was being applied to all the dots thereof, under the following conditions: resistance: 500 Ω; activation energy: 26.0 mJ/mm$^2$ and printing speed: 100 mm/sec. Also, the pressure of the platen roll was set to 6 kgf/line. As a result, printing/attaching could be performed with no problems.

Example 3-9

<Preparation of Coating Liquid for Forming Magnetic Recording Layer>

The following components were homogenously mixed to prepare a coating liquid for forming a magnetic recording layer.

Barium ferrite (MC127, product of TODA KOGYO CORP., solid): 100 parts by mass
Sodium polycarboxylate (Aron T-40, product of TOAGOSEI CO., LTD., solid): 5 parts by mass
Aqueous latex of polyurethane resin (UD-500, product of Mitsui Chemicals, Inc., solid): 30 parts by mass
Water: 200 parts by mass The above-prepared coating liquid was applied onto one surface of a support: a paper having a basis weight of 160 g/m$^2$, in an amount of 30 g (dry)/m$^2$, followed by magnetic field orientation. Subsequently, the support was dried at 110° C. to form a magnetic recording layer. Thereafter, the other surface of the support was provided with a thermosensitive recording layer in the same manner as in Example 3-5, to thereby form a thermosensitive recording type magnetic ticket paper. The thus-formed ticket paper could be discharged from a ticket-vending machine (product of TAKAMIZAWA CYBERNETICS COMPANY, LTD.) with no problems.

Comparative Example 3-1

—Production of Thermosensitive Recording Material—

The procedure of Example 3-1 was repeated, except that the 10% aqueous solution of acetoacetyl-modified polyvinyl alcohol and the 40% aqueous solution of glyoxazole (product of Mitsui Chemicals, Inc.), which had been used for forming the second protective layer, were changed respectively to 10% aqueous solution of itaconic acid-modified polyvinyl alcohol (KL-318, product of KURARAY Co., LTD., modification rate: 1 mol %) and 10% aqueous solution of polyamide-epichlorohydrine (WS535 (trade name), product of Seiko PMC Corporation), to thereby produce a thermosensitive recording material of Comparative Example 3-1.

Comparative Example 3-2

—Production of Thermosensitive Recording Material—

The procedure of Example 3-1 was repeated, except that the 10% aqueous solution of acetoacetyl-modified polyvinyl alcohol and the 40% aqueous solution of glyoxazole (product of Mitsui Chemicals, Inc.), which had been used for forming the second protective layer, were changed respectively to 10% aqueous solution of sulfonic acid-modified polyvinyl alcohol (Goselan L-326, product of Nippon Synthetic Chemical Industry Co., Ltd.) and 10% aqueous solution of polyamide-epichlorohydrine (WS535 (trade name), product of Seiko PMC Corporation), to thereby produce a thermosensitive recording material of Comparative Example 3-2.

Comparative Example 3-3

—Production of Thermosensitive Recording Material—

The procedure of Example 3-1 was repeated, except that the thermosensitive color-developing layer-coating liquid, the first protective layer-coating liquid and the second protective layer-coating liquid were applied with a rod bar, to thereby produce a thermosensitive recording material of Comparative Example 3-3.

Comparative Example 3-4

The procedure of Example 3-2 was repeated, except that the coating rate was changed from 600 m/min to 300 m/min, to thereby produce a thermosensitive recording material of Comparative Example 3-4.

Comparative Example 3-5

The procedure of Example 3-1 was repeated, except that the first protective layer-coating liquid [Liquid E] was not applied, and that the second protective layer-coating liquid [Liquid G] was applied so that the deposition amount after drying was 2.0 g/m$^2$, to thereby produce a thermosensitive recording material of Comparative Example 3-5.

Each of the thus-produced thermosensitive recording materials was evaluated for various properties. The results are shown in Table 3.

<Relative Sensitivity>

Each thermosensitive recording material was evaluated in the same manner as described above, except that the value of Comparative Example 3-1 was used as a reference value.

<Transferability Under High-Temperature, High-Humidity Conditions>

After each thermosensitive recording material and a printer (SM-90, product of Teraoka Seiko Co.) had been allowed to stand for one hour in a high-temperature, high-humidity environment; i.e., at 40° C. and 90% relative humidity, the thermosensitive recording material was printed and evaluated based on its printing length. The printing length refers to a length from the printing start area of a specific printing pattern printed by a printer to the printing end area thereof. When the transferability is excellent, the printing pattern is correctly printed, and the printing length of the printing pattern and that of an actually printed sample match. Whereas when the transferability is poor, transferability problems arise due to sticking between the thermosensitive recording material and the thermal head, so the printing area is shortened when printed, and moreover meandering occurs when the thermosensitive recording material is transferred. As a result, the printing length of the actually printed sample is shorter than the printing length of the printing pattern. In the present test, a printing pattern with a printing length of 100 mm was used.

<Plasticizer Resistance>

Each thermosensitive recording material was evaluated for plasticizer resistance in the same manner as described above.

<Plasticizer Resistance of Back Surface>

Each thermosensitive recording material was evaluated for plasticizer resistance of the back surface in the same manner as described above.

<Dot Reproducibility>

Each thermosensitive recording material was evaluated for dot reproducibility in the same manner as described above.

TABLE 3

| | Relative sensitivity | Transferability | Plasticizer resistance | Plasticizer resistance of back surface | Dot reproduciblity |
|---|---|---|---|---|---|
| Ex. 3-1 | 1.00 | 95 | 1.25 | 1.21 | B |
| Ex. 3-2 | 1.01 | 98 | 1.25 | 1.21 | B |
| Ex. 3-3 | 1.01 | 98 | 1.24 | 1.21 | B |
| Ex. 3-4 | 1.00 | 100 | 1.25 | 1.20 | B |
| Ex. 3-5 | 1.13 | 100 | 1.24 | 1.22 | A |
| Ex. 3-6 | 1.01 | 100 | 1.25 | 1.26 | B |
| Comp. Ex. 3-1 | 1.00 | 50 | 1.24 | 1.20 | B |
| Comp. Ex. 3-2 | 0.98 | 45 | 1.20 | 1.21 | B |
| Comp. Ex. 3-3 | 0.93 | 95 | 1.13 | 1.21 | B |
| Comp. Ex. 3-4 | 0.93 | 96 | 1.20 | 1.20 | B |
| Comp. Ex. 3-5 | 0.97 | 95 | 1.02 | 1.21 | B |

As is clear form Table 3, the thermosensitive recording materials of Comparative Examples 3-1 and 3-2, containing, in their second protective layer, itaconic acid-modified polyvinyl alcohol and sulfonic acid-modified polyvinyl alcohol, respectively, were found to exhibit considerably poor transferability under high-temperature, high-humidity conditions. The thermosensitive recording materials of Examples, which had been produced by a curtain coating method at a coating rate of as fast as 600 m/min, were found to be excellent in head-matching property while maintaining high sensitivity and good storage stability. The thermosensitive recording material of Comparative Example 3-3, in which the layers had been formed with a rod bar, was found to considerably degrade in relative sensitivity and plasticizer resistance. As in Comparative Example 3-4, even when the coating rate was decreased to 300 m/min, improved results were not found to be obtained, indicating that the thermosensitive recording material of the present invention is quite suitable for high-speed coating. Notably, the difference in plasticizer resistance was 0.11 to 0.12 between Examples and Comparative Example 3-3, which values are very large and significant in such thermosensitive recording materials. Also, the thermosensitive recording material of Comparative Example 3-5, having a protective layer with a single-layered structure, was found to degrade in plasticizer resistance.

The present invention has been described above by way of preferred embodiments. While particular embodiments of the present invention have been described, it is apparent that various modifications may be made without departing from the scope of the claims. That is, it should not be construed that the present invention is limited to those particular embodiments.

INDUSTRIAL APPLICABILITY

The thermosensitive recording material of the present invention can be advantageously used as materials which develop color through application of heat with, for example, a thermal printer, such as receipts, tickets (for railroads, airplanes, events, etc.) and lotteries (Lot 6 and Numbers).

What is claimed is:

1. A thermosensitive recording material comprising:

a support, an under layer laid over the support, the under layer containing a plastic hollow particle, a thermosensitive color-developing layer laid over the under layer, the thermosensitive color-developing layer containing a leuco dye and a developer, a first protective layer containing a water-soluble resin and a crosslinking agent, and a second protective layer containing a water-soluble resin, a crosslinking agent and a pigment, wherein two or more layers including the thermosensitive color-developing layer are formed through simultaneous coating by a curtain coating method at a flow rate greater than 300 m/min, and the water soluble resin in one or more of the protective layers contains an acetoacetyl-modified polyvinyl alcohol.

2. The thermosensitive recording material according to claim 1, wherein first and second layers which are formed through the simultaneous coating by the curtain coating method are the thermosensitive color-developing layer and a protective layer containing a water-soluble resin, a crosslinking agent and a pigment, respectively.

3. The thermosensitive recording material according to claim 2, wherein the pigment is a basic filler which is aluminum hydroxide, calcium carbonate or a mixture thereof.

4. A thermosensitive recording material according to claim 1, wherein first, second and third layers which are formed through the simultaneous coating by the curtain coating method are the thermosensitive color-developing layer, a first protective layer containing a water-soluble resin and a crosslinking agent, a second protective layer containing a water-soluble resin, a crosslinking agent and a pigment, respectively.

5. The thermosensitive recording material according to claim 4, wherein the second protective layer is formed by a blade coating method.

6. The thermosensitive recording material according to claim 1, wherein the water-soluble resins are the same.

7. The thermo sensitive recording material according to claim 1, wherein the under layer is formed by a blade coating method.

8. The thermosensitive recording material according to claim 1, wherein the thermosensitive recording material contains a silicone resin particle in an uppermost layer thereof.

9. The thermosensitive recording material according to claim 1, further comprising a back layer over the back surface of the support, wherein the back layer contains a water-soluble resin, a crosslinking agent and a pigment.

10. The thermosensitive recording material according to claim 9, further comprising an adhesive layer and a release paper which are sequentially laminated over the back surface of the support or the back layer.

11. The thermo sensitive recording material according to claim 9, further comprising a thermosensitive adhesive layer over the back surface of the support or the back layer, wherein the thermo sensitive adhesive layer develops adhesiveness by the action of heat.

12. The thermo sensitive recording material according to claim 9, further comprising a magnetic recording layer over the back surface of the support or the back layer.

* * * * *